US010066384B1

(12) United States Patent
Hendry

(10) Patent No.: US 10,066,384 B1
(45) **Date of Patent: *Sep. 4, 2018**

(54) SCREEN SUPPORT ASSEMBLY WITH WIDE LATERAL SUPPORT EFFICIENCY

(71) Applicant: Thomas G. Hendry, Lehigh Acres, FL (US)

(72) Inventor: Thomas G. Hendry, Lehigh Acres, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/470,893

(22) Filed: Mar. 27, 2017

Related U.S. Application Data

(63) Continuation of application No. 15/211,898, filed on Jul. 15, 2016, now Pat. No. 9,605,425, which is a continuation-in-part of application No. 14/660,673, filed on Mar. 17, 2015, now Pat. No. 9,422,711.

(51) Int. Cl.

| | |
|---|---|
| ***E04B 1/38*** | (2006.01) |
| ***E04B 1/19*** | (2006.01) |
| ***E04B 1/24*** | (2006.01) |
| ***E04B 1/41*** | (2006.01) |

(Continued)

(52) U.S. Cl.
CPC ..... *E04B 1/2403* (2013.01); *E04B 1/1903* (2013.01); *E04B 1/40* (2013.01); *E04H 12/2269* (2013.01); *E04B 2001/2415* (2013.01); *E04B 2001/2421* (2013.01);
(Continued)

(58) Field of Classification Search
CPC ..... Y10T 403/342; Y10T 403/345; Y10T 403/347; Y10T 403/443; F16B 7/044; F16B 7/0406; F16B 7/0446; E04B 1/0046; E04B 1/40; E04B 1/2403; E04B 1/585; E04B 1/5825; E04B 1/5831; E04B 1/5843; E04B 2001/2448; E04B 2001/2451; E04B 2001/2457; E04B 2001/2406; E04B 2001/2415; E04B 2001/2418; E04B 2001/2421; E04B 2001/405; E04H 12/24; E04H 15/34; E04H 17/1421
USPC ..... 52/653.2, 655.1, 656.9, 712, 848, 849, 52/585.1; 403/170, 171, 176, 178, 292, 403/295
See application file for complete search history.

(56) References Cited

U.S. PATENT DOCUMENTS 1,430,809 A * 10/1922 Ilseng ..... B60J 10/74 292/DIG. 47
3,222,841 A 12/1965 Lipof
(Continued)

FOREIGN PATENT DOCUMENTS

DE 20 2014 103 897 U1 * 10/2014
EP 2988007 A1 * 2/2016 ..... F16B 7/0446
(Continued)

*Primary Examiner* — Robert Canfield
(74) *Attorney, Agent, or Firm* — Hanrahan Law Firm, P.A.; Benjamin M. Hanrahan

(57) ABSTRACT

A support assembly for providing a high degree of lateral strength and integrity is presented herein. The support assembly includes a beam support bracket having at least one laterally disposed elongated portion that is slidingly engaged with a corresponding lateral beam. The elongated portion of the beam support bracket is defined by spaced apart first and second support plates each including oppositely disposed edges which will mate with corresponding ledges, protrusion or reinforced corners within the lateral beam.

15 Claims, 15 Drawing Sheets

(51) Int. Cl.
*E06B 9/52* (2006.01)
*E04H 12/22* (2006.01)

(52) U.S. Cl.
CPC . *E04B 2001/2451* (2013.01); *E04B 2001/405* (2013.01); *E06B 9/52* (2013.01)

(56) References Cited

U.S. PATENT DOCUMENTS 3,255,769 A * 6/1966 Lloyd ..... A01G 9/14 135/138
3,304,108 A * 2/1967 Hamilton ..... F16L 41/025 403/295
3,354,891 A * 11/1967 Brown ..... B60J 7/102 135/88.09
3,532,369 A 10/1970 Reilly
3,561,801 A 2/1971 Chiu
3,620,558 A 11/1971 MacMillian
3,645,569 A 2/1972 Reilly
3,656,515 A 4/1972 Wogerbauer et al.
3,666,298 A 5/1972 Reilly
3,726,551 A 4/1973 Levenberg
3,786,612 A 1/1974 Baker
3,867,045 A 2/1975 Beals
3,922,101 A 11/1975 Salmon, Jr. et al.
3,955,702 A 5/1976 Lundy
4,076,432 A 2/1978 Glaser
4,570,406 A 2/1986 DiFazio
4,718,184 A * 1/1988 Sherman ..... A47G 1/10 40/785
4,785,591 A 11/1988 Dahlen
4,831,804 A * 5/1989 Sayer ..... E06B 3/222 52/204.593
4,841,688 A 6/1989 Rinaldi
4,960,343 A 10/1990 Reilly
5,156,484 A * 10/1992 Allen ..... E04C 3/40 403/295
5,203,135 A 4/1993 Bastian
5,383,723 A 1/1995 Meyer
5,485,705 A 1/1996 Guillemet
D376,855 S 12/1996 Leung
5,605,410 A 2/1997 Pantev
5,904,437 A 5/1999 Allen
6,062,761 A 5/2000 Allen
6,279,288 B1 8/2001 Keil
6,279,289 B1 8/2001 Soder et al.
6,338,226 B1 * 1/2002 Gauthier ..... A01G 9/14 47/17
6,339,891 B1 * 1/2002 Cox ..... A47G 1/10 40/782
D454,962 S 3/2002 Grace
6,668,495 B1 12/2003 Prince
6,826,885 B2 12/2004 Raskin et al.
7,080,492 B1 * 7/2006 Guiller ..... E04B 1/5831 182/186.4
7,155,874 B2 1/2007 Lee
7,223,044 B2 5/2007 Quintile
7,568,323 B2 8/2009 Shelton et al.
D603,065 S 10/2009 Hamilton et al.
7,628,563 B2 12/2009 Winkler
7,677,003 B2 * 3/2010 Baughn ..... E06B 3/9682 52/473
D616,114 S 5/2010 Harder
7,739,841 B1 * 6/2010 Puckett ..... E04B 1/24 52/639
7,832,180 B2 * 11/2010 Dolby ..... E04B 2/96 52/235
D739,960 S 9/2015 Britton
9,422,711 B1 8/2016 Hendry
9,605,425 B1 3/2017 Hendry
D787,094 S 5/2017 Britton
D815,758 S 4/2018 Hendry
2004/0035082 A1 * 2/2004 Hudoba ..... E06B 9/02 52/656.7
2005/0193680 A1 * 9/2005 Wang ..... E06B 3/9688 52/656.9
2006/0115324 A1 * 6/2006 Zenda ..... F16B 7/18 403/292
2007/0074480 A1 * 4/2007 Kleila ..... E04C 3/04 160/201
2007/0180786 A1 8/2007 Sotuyo
2007/0266671 A1 * 11/2007 Chromy ..... E04C 3/06 52/844
2008/0190068 A1 * 8/2008 Tapscott ..... E04B 1/2403 52/690
2013/0272777 A1 * 10/2013 Hayter ..... E06B 3/9645 403/205
2014/0250821 A1 9/2014 Strickland et al.
2015/0121788 A1 * 5/2015 Kim ..... E06B 3/22 52/309.1
2016/0138261 A1 5/2016 Zhang et al.

FOREIGN PATENT DOCUMENTS

GB 1009846 A * 11/1965 ..... E04F 11/181
WO WO94/21867 9/1994
WO WO00/66896 11/2000
WO 2012016297 A1 * 2/2012 ..... E04B 1/5831

* cited by examiner

SCREEN SUPPORT ASSEMBLY WITH WIDE LATERAL SUPPORT EFFICIENCY

CLAIM OF PRIORITY/CROSS REFERENCE TO RELATED APPLICATIONS

The present application is a Continuation Patent Application of previously-filed, currently pending U.S. patent application Ser. No. 15/211,898 filed on Jul. 15, 2016, which is a Continuation-In-Part patent application of previously-filed U.S. patent application Ser. No. 14/660,673 filed on Mar. 17, 2015 (now U.S. Pat. No. 9,422,711). The contents of both previously-filed patent applications are incorporated herein in their entirety by reference.

FIELD OF THE INVENTION

The present invention is generally directed to a support assembly, and in particular, a screen support assembly with a wide lateral support efficiency in that with the construction of the various embodiments of the present invention, horizontal or lateral beams may extend large distances from the vertical supports, allowing for large or wide open screen portions between vertical supports.

BACKGROUND OF THE INVENTION

Screen enclosures for patios, pool areas, porches, etc. are well known in the art and are installed on many homes, buildings, and apartments throughout the United States and the World. Such screen enclosures are often constructed by installing closely spaced vertical posts or beams with horizontal beams spanning between them. Screen material, often in square or rectangular panels, will then fill the open spaces between the vertical posts and horizontal beams.

The problem, however, is that the vertical posts, and sometimes the horizontal beams, may obstruct views and scenery for those individuals positioned within the enclosure and who wish to gaze or look out through the screen and beyond the enclosure. This is particularly true for many luxurious homes and buildings that overlook bodies of water, such as lakes, oceans, etc. or golf courses, pastures, mountains, etc. While the screened enclosure may be beneficial in protecting the enclosed area from many of the outside elements, wildlife, and insects, it also obstructs the once stunning view of the outside scenery.

Accordingly, there is a need in the art for a new screen enclosure or support assembly that includes a high degree of lateral strength and structural integrity between the joints where the vertical and horizontal or lateral beams meet. The high strength and integrity of the proposed screen enclosure and support assembly must support horizontal beams that can span great distances (e.g., greater than thirty feet) between vertical posts, thereby creating a wide open viewing panel that is not obstructed by intermediate vertical support posts.

SUMMARY OF THE INVENTION

Accordingly, the present invention is generally directed to a support assembly which includes a high degree of lateral strength and integrity in order to allow for lateral beams to span great distances between vertical supports. This provides wide open spaces or screened panels that create unobstructed or less obstructed views there through.

In particular, the support assembly of at least one embodiment includes a beam support bracket having at least one laterally disposed elongated portion that is slidingly or telescopically engaged with a corresponding lateral beam. For instance, the elongated portion of the beam support bracket is defined by spaced apart first and second extension members or support plates. In some embodiments the extension members or support plates may be connected to one another via internal support webbing or spacer plates, while in other embodiments, the support plates may be disconnected or otherwise independent of one another.

Further, the extension members or support plates each include oppositely disposed edges, such as, but not limited to, upper and lower edges, which will mate with corresponding ledges or protrusions disposed within the lateral beam, for example, at or near inside corners thereof.

Specifically, the lateral beam(s) may include rectangular-shaped tubes manufactured out of extruded aluminum or other materials capable of facilitating the implementation of the present invention. The beam(s) include an internal receiving portion with reinforced corners or surface protrusions which define channels through which the extension members or support plates of the beam support bracket are slidingly or telescopically engaged.

For instance, the elongated portion of the beam support bracket may be disposed within the internal receiving portion of the lateral beam such that the oppositely disposed edges of each of the extension members or support plates correspondingly mate with the reinforced corners on the inside of the lateral beam. The mating engagement between the bracket and the beam restrict side-to-side, up and down and rotational movement there between.

Further embodiments may also include a support post with an internal receiving portion similar to that of the lateral beam. Specifically, the support post may include reinforced corners on the inside thereof in order to define channels through which a downwardly directed portion of the support beam will fit or engage. Certain embodiments of the support post are constructed from an extruded aluminum, similar to the lateral beams, although other materials and methods of construction may be implemented.

The lateral beams and the support post may further include screen retention assemblies, such as spline grooves, within which a screen panel and retention spline may be inserted for attaching screen material thereto. Other screen retention assemblies may be implemented or incorporated within the full spirit and scope of the present invention.

Further, it should also be noted that the screen or support assembly of certain embodiments of the present invention may be constructed to withstand high velocity winds, including hurricane force winds. Thus, certain embodiments may be constructed to pass stringent wind velocity standards and tests that may be found or implemented in many parts of the United States, including Florida, and Worldwide.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
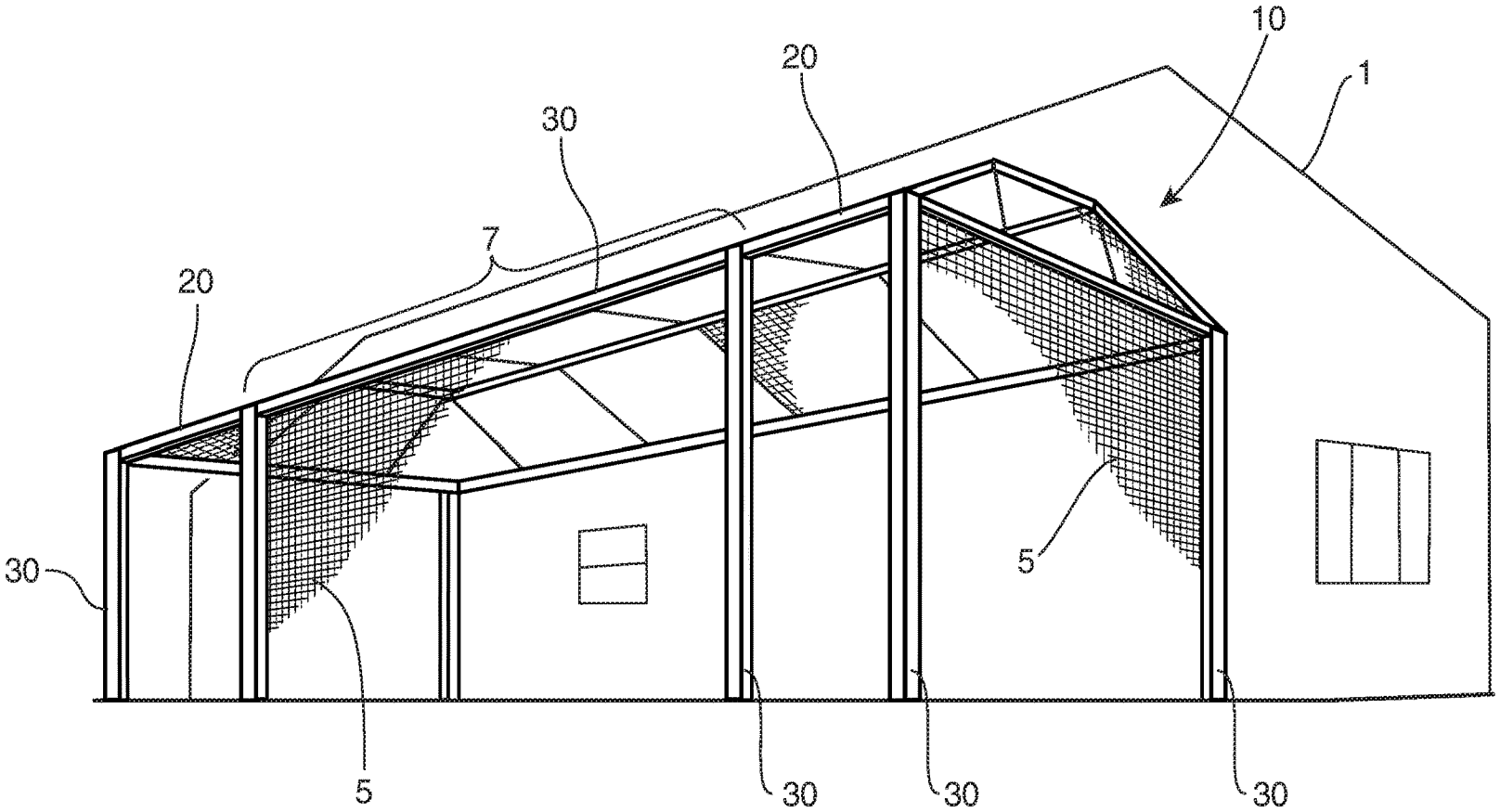
FIG. 1 is a perspective view of the support assembly of at least one embodiment of the present invention installed on home or other structure.

As shown in the accompanying drawings, and with particular reference to FIG. 1, the present invention is directed to a support assembly, as generally shown by reference character 10. Particularly, in the exemplary embodiment illustrated in FIG. 1, the support assembly 10 is structured to support one or more screen panels 5 as is shown installed on the rear portion of a structure 1, such as a home. The screened or other enclosure may enclose a pool, patio, or other area. However, while many implementations of the support assembly 10 of the present invention may be used to support or construct screen enclosures on homes, businesses or other structures 1, as generally illustrated in FIG. 1, for example, other embodiments may be used for other various support assembly applications.

In any event, as provided herein, the support assembly 10 of the various embodiments of the present invention provides significant lateral or horizontal strength and integrity allowing for the construction of or implementation of wide open screen panels or other areas, for example, as generally represented by reference character 7 in FIG. 1. Particularly, the large or wide open screen panels may be configured such that vertical support members 30, which at least partially support the horizontal or lateral beams 20, may be positioned great distances from one another, including, for example, up to approximately thirty-five (35) feet or more. Such a configuration, made possible by the lateral strength and integrity between the horizontal or lateral beams 20 and the vertical support posts 20, creates large, wide and quite visually stunning, viewing panels unobstructed by vertical support posts 30.

Figure 2A:
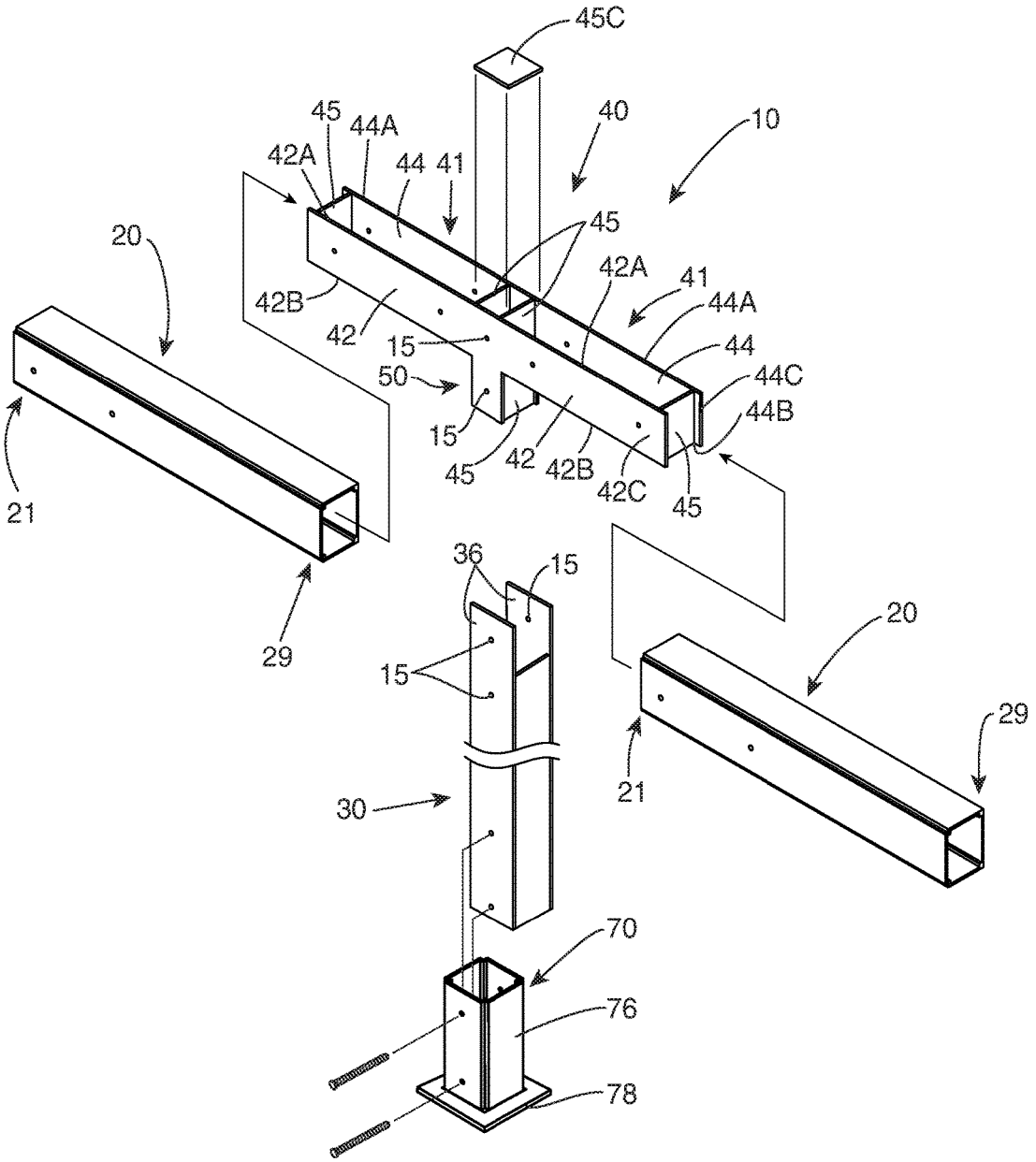
FIG. 2A is an exploded view of the support assembly as disclosed in accordance with at least one embodiment of the present invention.
Figure 2B:
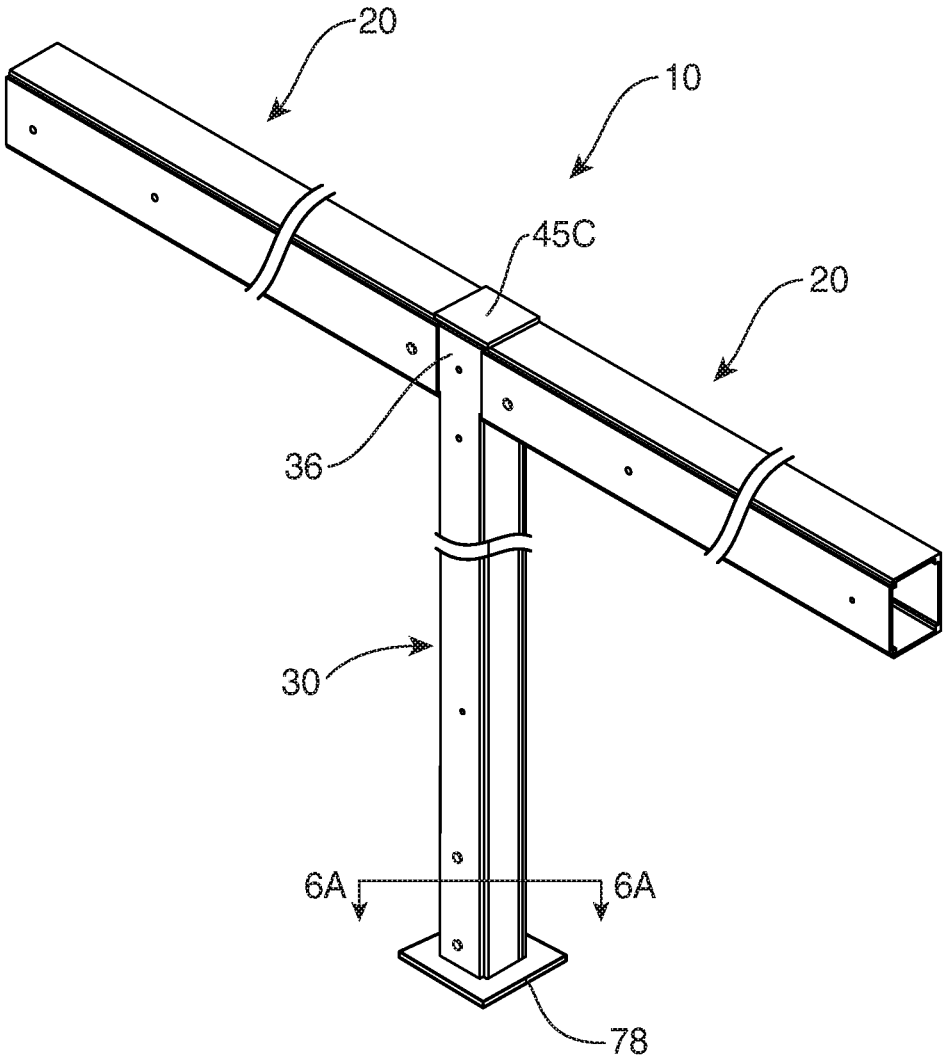
FIG. 2B is a perspective view of the support assembly illustrated in FIG. 2A.

For instance, referring now to FIGS. 2A and 2B, the support assembly 10 includes a beam support bracket 40, at least one lateral beam 20, and a substantially vertically oriented support post 30. As described herein, the lateral beam(s) 20 are slidingly engaged with or otherwise over elongated portions 41 of the beam support bracket 40. It should be noted, however, that a reverse configuration may be implemented wherein the beam support bracket 40 is configured to slide over the lateral beam(s) 20. Similarly, a downward portion 50 of the beam support bracket 40 is slidingly engaged within an end of the support post 30, such as an upper end, although, again, a reverse embodiment may be implemented wherein the support post slides within the downward portion 50.

It should also be noted that while FIGS. 2A and 2B illustrate a "T" shaped beam support bracket, other shapes may be contemplated within the full spirit and scope of the present invention in order to install or construct a support assembly 10, for example, as shown in FIG. 1. For instance, the beam support assembly 40 may comprise a corner or "L" shape, or other configurations which may facilitate support angles, etc. Accordingly, a single beam support bracket 40 may support or engage with one, two or more lateral beams 20.

Still referring to FIG. 2A, the beam support bracket 40 of at least one embodiment of the present invention includes laterally spaced first and second extension members or support plates 42, 44 which define the elongated portion(s) 41 that is/are slidingly engaged or disposed within a corresponding lateral beam 20. Each of the extension members or support plates 42, 44 include oppositely disposed edges, such as, but not limited to, upper edges 42A, 44A and lower edges 42B, 44B that will correspondingly mate with cooperatively constructed and disposed portions within the lateral beam(s) 20, as described herein.

Further, in at least one exemplary embodiment of the present invention, the beam support bracket 40 is constructed by securing a plurality of spacer plates 45 between the two laterally spaced extension members 42, 44 in order to space the extension members 42, 44 a proper distance from one another to correspondingly and slidingly fit within the lateral beam 20. Accordingly, the extension members 42, 44 may comprise separately structured metal, aluminum or other like plates laterally spaced from one another via at least one, but more practically, a plurality of spacer plates 45. For instance, in the "T" shaped construction illustrated in FIG. 2A, the beam support bracket 40 may comprise two (2) "T" shaped support plates 42, 44 laterally spaced from one another and interconnected to one another via one or more spacers 45. The "T" shape creates two elongated portions 41 extending from the downward portion 50, although, as noted above, other shapes and brackets can be implemented. The spacer plates 45 may thus be welded, screwed, glued, adhered, or otherwise connected to the inside surface of the plates or extension members or support plates 42, 44. Other ways of manufacturing or constructing the beam support bracket 40 may be contemplated within the full spirit and scope of the various embodiments disclosed herein.

Figure 3A:
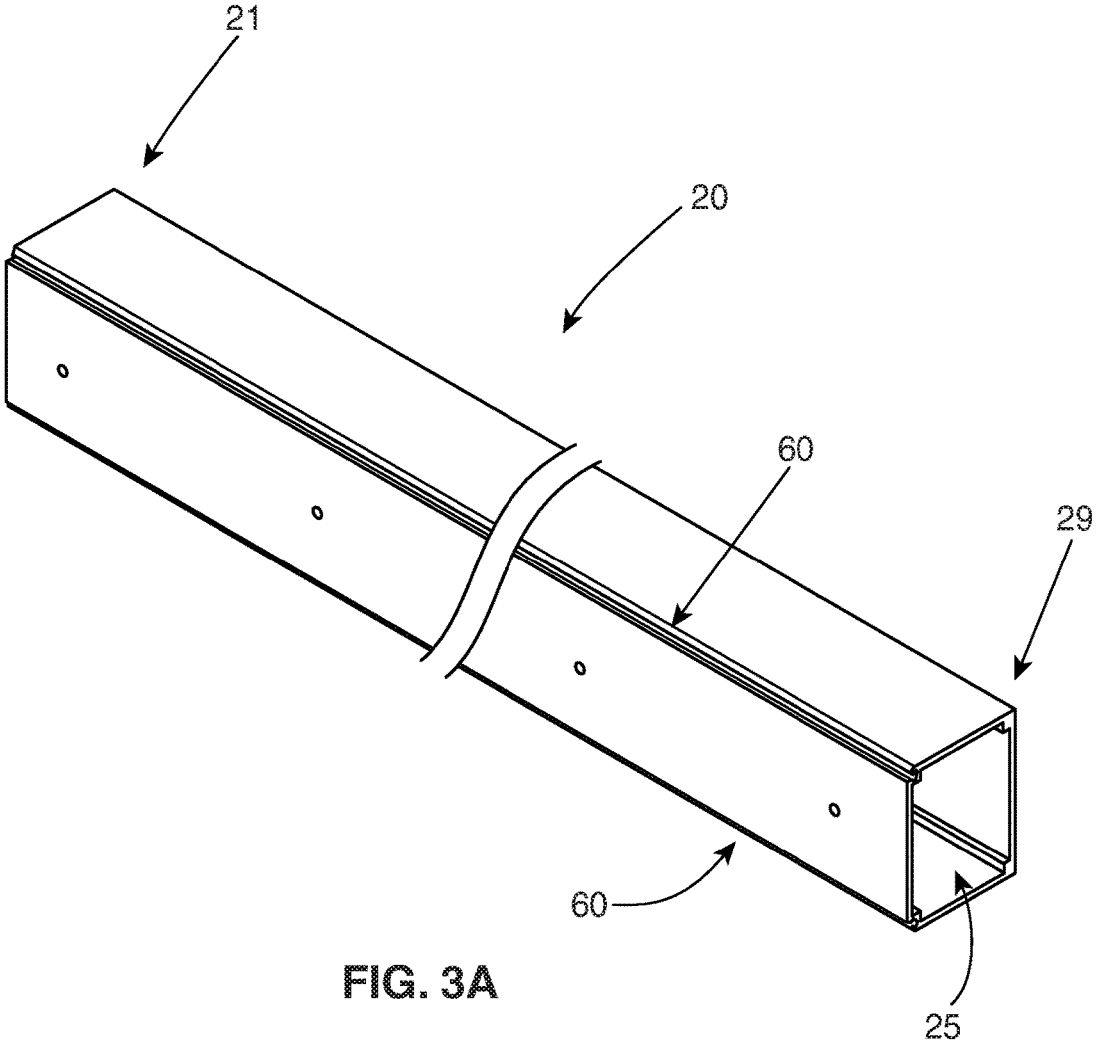
FIG. 3A is a perspective view of a lateral beam as disclosed in accordance with at least one embodiment of the present invention.
Figure 3B:
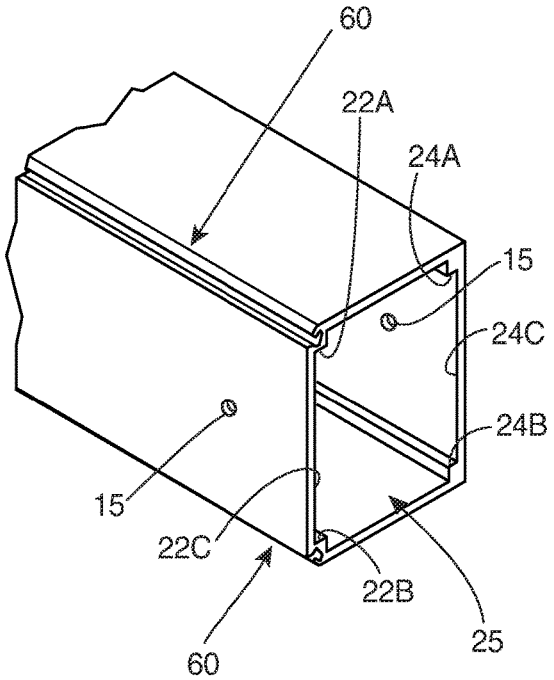
FIG. 3B is a partial perspective end view of the lateral beam illustrated in FIG. 3A.

Referring now to FIGS. 3A and 3B, an exemplary embodiment of the lateral beam 20 is shown. For instance, the lateral beam 20 may be connected to a support bracket 40 on each end 21, 29. Due to the significant strength and integrity of the interconnections between the lateral beam 20 and the support brackets 40, the lateral beam 20 may, in some instances, span a distance of approximately thirty-five (35) feet or more between the support brackets 40 or vertical supports 20. Of course, other distances, whether longer or shorter may be implemented in order to construct the support assembly 10, for example, as shown in FIG. 1. Further, the lateral beams 20 and/or the support post 30 of the various embodiments disclosed herein may include one or more screen retention assemblies 60, such as retention channels configured to receive a portion of a screen panel and a corresponding spline member therein. Other screen retentions assemblies now known or later developed in the art are contemplated in order to secure a screen panel to the lateral beam 20.

Furthermore, the lateral beams 20 of the various embodiments of the present invention may be constructed by way of metal or aluminum extrusion techniques in that the lateral beam(s) 20 may be extruded pieces of aluminum or other metal. For example, in one illustrative embodiments, the lateral beams 20 may comprise 60-63 T6 extruded aluminum, although other materials may be implemented in order to facilitate the practice of the present invention in the intended manner. In addition, the lateral beam(s) 20 of at least one exemplary embodiment may comprise a rectangular tube comprising a width of six (6) inches, a height of eight (8) inches and a thickness of 0.19 inches. Other dimensions and configuration may be implemented within the scope of the present invention.

Still referring to FIGS. 3A and 3B, the lateral beam 20 includes an internal receiving portion 25 with first and second surface protrusion pairs or reinforced corner portions, wherein the first surface protrusion pair may be defined by a first upper surface protrusion 22A and a first lower surface protrusion 22B, and the second surface protrusion pair defined by a second upper surface protrusion 24A and a second lower surface protrusion 24B. For instance, the surface protrusions 22A, 22B, 24A, 24B of the various embodiments comprise cooperatively structured surfaces or ledges that will correspondingly mate or fit with the upper and lower edges 42A, 42B, 44A, 44B of the first and second extension members 42, 44 of the beam support bracket 40. In the embodiments shown, the upper and lower edges 42A, 42B, 44A, 44B and the surface protrusions 22A, 22B, 24A, 24B comprise generally corresponding flat surfaces, although it should be noted that other surface configurations such as curved surfaces, locking surfaces, tongue and groove, etc. may be contemplated.

Furthermore, as shown in FIGS. 3A and 3B, the surface protrusions 22A, 22B, 24A, 24B are disposed in the inside corners of the internal receiving portion 25 of the lateral beam 20, thereby providing reinforced corner portions. Particularly, the first surface protrusions 22A and 22B are disposed on adjacent corners and in some implementations, vertically aligned corners such that the first surface protrusions 22A and 22B will mate with the first upper and lower edges 42A, 42B of the first extension member 42. Similarly, the second surface protrusions 24A and 24B are disposed on a different set of adjacent corners within the lateral beam 20 and in some implementations, vertically aligned corners such that the second surface protrusions 24A and 24B will mate with the second upper and lower edges 44A, 44B of the second extension member 44 of the beam support bracket 40.

In addition, and still referring to FIGS. 3A and 3B, the internal receiving portion 25 of the lateral beam 20 includes internal lateral surfaces, such as a first internal lateral surface 22C and a second internal lateral surface 24C. The first internal lateral surface 22C is disposed between the first upper surface protrusion 22A and the first lower surface protrusion 22B, and similarly, the second internal lateral surface 24C is disposed between the second upper surface protrusion 24A and the second lower surface protrusion 24B. In this manner, the external lateral surfaces 42C and 44C of the elongated portions 42, 44 of the support bracket 40 will correspondingly mate with the internal lateral surfaces 22C, 24C of the lateral beam 20.

Accordingly, the first surface protrusion pair 22A, 22B and the connecting internal surface 22C define a first side channel within which the first extension member 42 of the beam support bracket 40 will slide. Similarly, the second surface protrusion pair 24A, 24B and the connecting internal surface 24C define a second channel within which the second extension member 44 of the beam support bracket will slide.

Figure 4B:
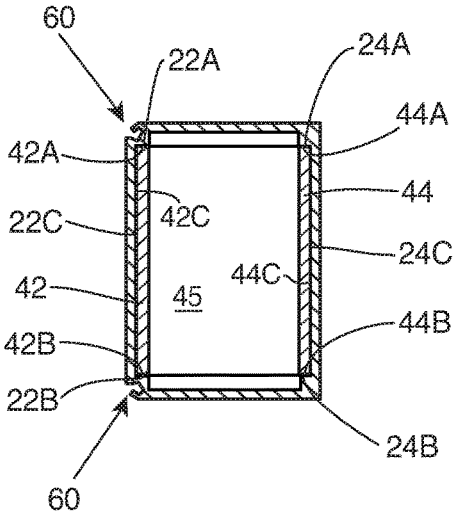
FIG. 4B is a cut-away view of FIG. 4A along line 4B-4B as illustrated therein.
Figure 4A:
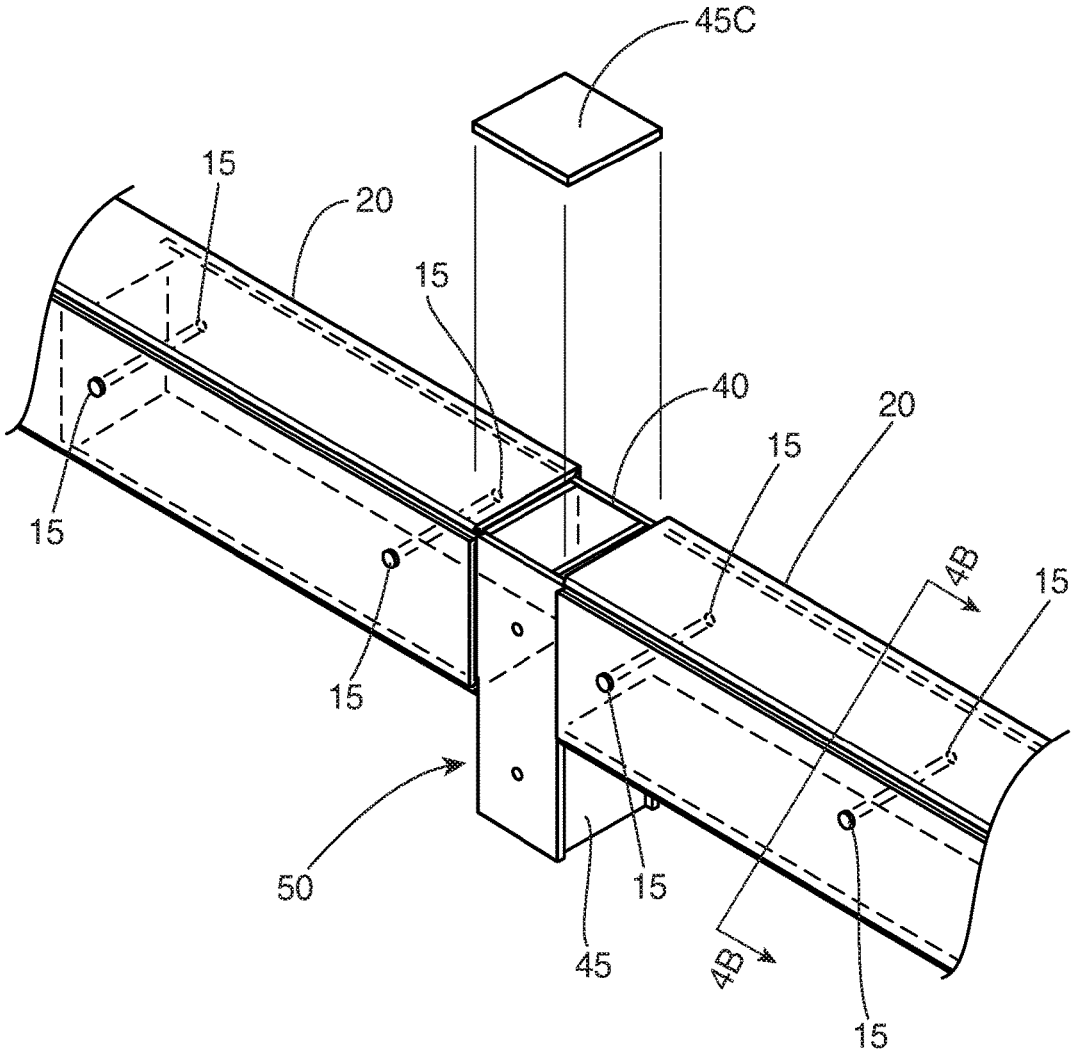
FIG. 4A is a partially exploded and cut-away view of the beam support bracket and lateral beams as disclosed in accordance with at least one embodiment of the present invention.

Furthermore, FIGS. 4A and 4B illustrate exemplary embodiments wherein the lateral beam(s) 20 is slidingly or telescopically engaged with or onto the beam support bracket 40. Particularly, FIG. 4B is a cross-sectional view taken along line 4B-4B shown in FIG. 4A. For instance, the elongated portion 41 of the beam support bracket 40 is disposed within the internal portion 25 of the lateral beam 20 in a manner such that the oppositely disposed or upper and lower edges 42A, 42B of the first extension member 42 correspondingly mate with the first surface protrusion pair (for example, defined by the first upper surface protrusion 22A and first lower surface protrusion 22B in one embodiment) and the oppositely disposed edges or upper and lower edges 44A, 44B of the second extension member 44 of the same elongated portion 41 correspondingly mate with the second surface protrusion pair (for example, defined by the second upper surface protrusion 44A and the second lower surface protrusion 44B of one embodiment). In addition, the external lateral surfaces 42C and 44C of the elongated portions 42, 44 of the support bracket 40 are correspondingly aligned or mated with the internal lateral surfaces 22C, 24C of the lateral beam 20. The lateral beam 20 may be secured to the beam support bracket 40 by way of securing one or more bolts, screws, or other like securing mechanisms through correspondingly positioned and aligned holes, as generally represented as 15. Depending on the particular beam support bracket 40, a cap 45C may be secured to a top portion of the bracket 40, such as, for example, between adjacent lateral beams 40, as shown in FIG. 4A.

In this regard, the lateral beam 20 is secured into place on the beam support bracket 20 and is prevented from twisting, rotating, or otherwise moving relative to the beam support bracket 40. Particularly, the mating engagement between the various edges 42A, 42B, 44A, 44B and the corresponding protrusions 22A, 22B, 24A, 24B, as well as the mating alignment or engagement between the surfaces 42C, 44C and 22C, 24C restrict movement between the lateral beam 20 and the beam support bracket 40. In addition, the spacer plates or spacers 45 secured between the two extension members 42, 44 maintain the appropriate spacing between the extension members 42, 44 and thereby further restrict or contribute to the movement restriction between the lateral beam 20 and the beam support bracket 40.

Figure 5:
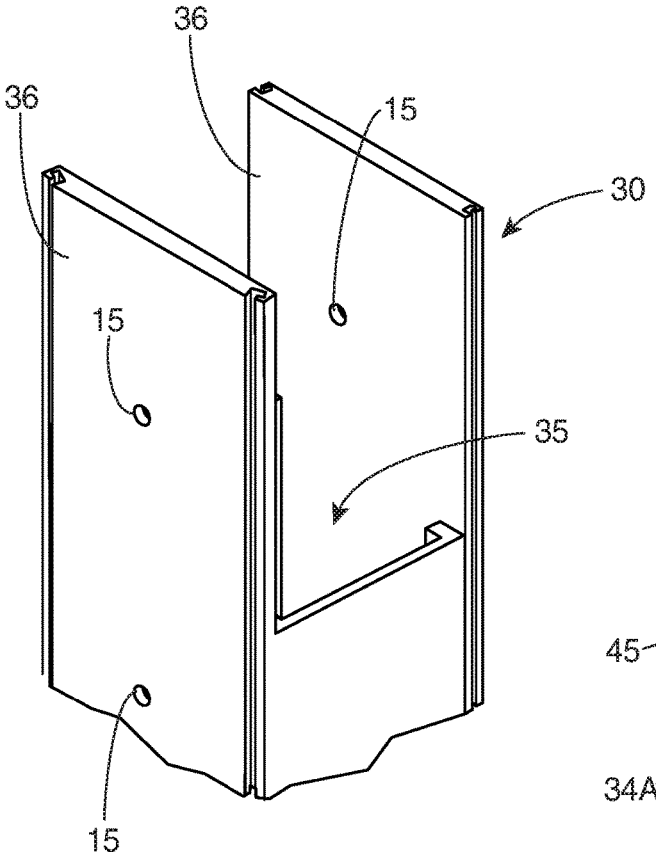
FIG. 5 is a partial end view of the support post as disclosed in accordance with at least one embodiment of the present invention.

Referring again to FIG. 2A, in at least one embodiment, the beam support bracket 40 further comprises a downward portion 50 defined by the laterally spaced first and second extension members 42, 44, for example. The downward portion 50 is structured to slidingly or telescopically fit or engage within a support post 30, in a similar manner as the elongated portion(s) 41 slidingly fit or engage within the lateral beams 20. For example, as shown in FIGS. 5 and 5A, the support post 30 includes an internal receiving portion 35 with a first surface protrusion pair 32A, 32B and a second surface protrusion pair 34A, 34B, each defining a first channel and a second channel, respectively.

Figure 5A:
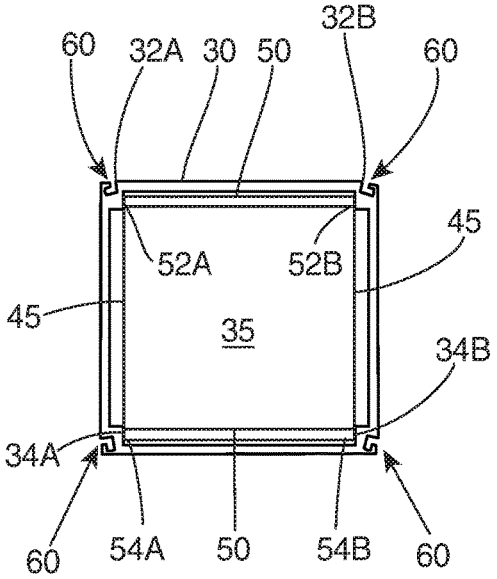
FIG. 5A is a cut away view of the interconnected support post and beam support bracket as disclosed in accordance with at least one embodiment of the present invention.

The downward portion 50 of the beam support bracket 40 includes corresponding edges 52A, 52B and 54A, 54B which correspondingly mate with the first and second channels defined by the surface protrusion portions 32A, 32B and 34A, 34B, as shown in FIG. 5A. Thus, the mating engagement between the edges 52A, 52B, 54A, 54B of the downward portion 50 and the surface protrusion portions 32A, 32B, 34A, 34B disposed in the internal receiving portion 35 of the support post 30 is structured to restrict movement, such as lateral, rotational or twisting movement between the beam support bracket 40 and the support post 30. In additional, the spacers 45 which, as above, are structured to maintain a corresponding spacing between the extension members 42, 44, may also restrict movement or contribute to the movement restriction between the beam support bracket 40 and the support post 30. Of course, screws, bolts or other securing mechanisms may be secured through or between the support post 30 and the beam support bracket 20, for example, through correspondingly aligned holes 15, which also contribute to the secure engagement and movement restriction relation between the support post 30 and the beam support bracket 20.

It should also be noted that, as illustrated in FIG. 5A, for example, the support post 50 may include a plurality of screen retention assemblies 60 for securely retaining a screen panel 5 therein. As an example, the screen retention assembly 60 may include a channel for securely retaining a portion of the screen panel 5 therein, along with a flexible or other spline for retaining the screen portion therein. Other screen retention assemblies may be incorporated within the full spirit and scope of the present invention.

In addition, the support post 30 of at least one embodiment of the present invention may include one or more upper flanges 36 extending upward beyond the interior portion 35. Accordingly, the flange(s) 36 of at least one embodiment, may extend in an at least partially overlapping relation with an external surface of the beam support bracket 40, as generally illustrated in FIG. 2A. Corresponding holes and bolts, screws or other securing mechanisms may be implemented to keep the flanges secured to the beam support bracket.

Furthermore, the support post(s) 30 of the various embodiments of the present invention may be constructed by way of metal or aluminum extrusion techniques in that the support posts(s) 30 may be a single piece of extruded aluminum or other metal. For example, in one illustrative embodiments, the support post(s) 30 may comprise 60-63 T6 extruded aluminum, although other materials may be implemented in order to facilitate the practice of the present invention in the intended manner. In addition, the support post(s) 30 of at least one exemplary embodiment may comprise a rectangular or square tube comprising a width of six (6) inches, a height of six (6) inches and a thickness of 0.25 inches. Other dimensions and configuration may be implemented within the scope of the present invention.

Figure 6:
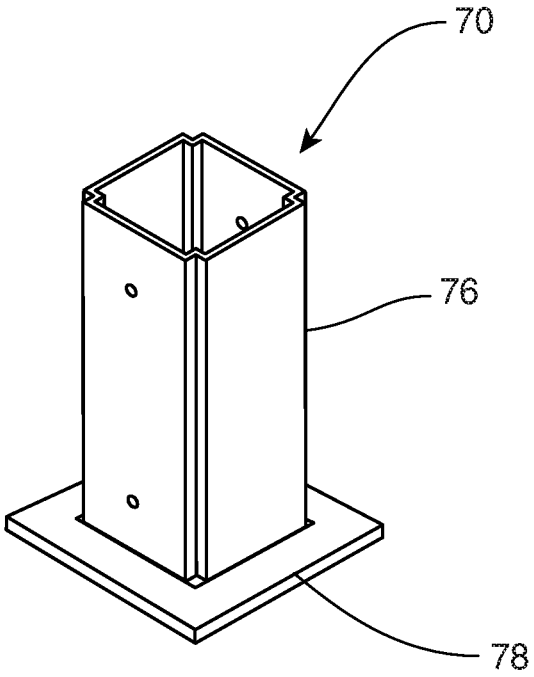
FIG. 6 is a perspective view of the support boot as disclosed in accordance with at least one embodiment of the present invention.
Figure 6A:
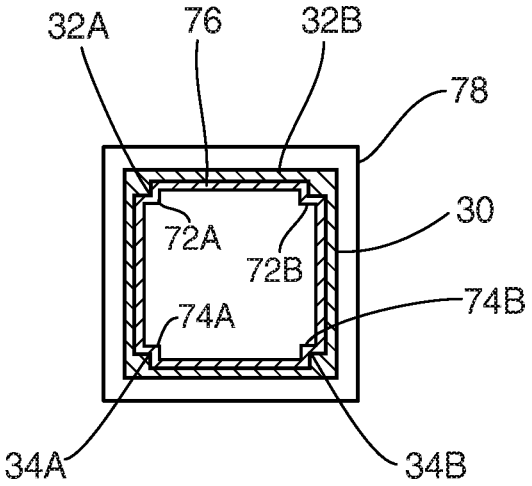
FIG. 6A is a cut-away view of the interconnected support boot and support post along line 6A-6A illustrated in FIG. 2A.

Additional features of certain embodiments of the present invention include a support boot 70 slidingly or telescopically engaged to or within a lower end of the support post 30. For example, as shown in FIGS. 6 and 6A, the support boot 70 of at least one embodiment comprises a generally upright portion 76 and a base 78. The base 78 may be flanged outward from the upright portion 76 in order to provide additional stability or support. The base 78 may be secured to a floor, concrete slab, ground, or other surface.

Further, still referring to FIGS. 6 and 6A, the upright portion 76 of the boot 70 may include surface indents or external receiving corner portions 72A, 72B, 74A, 74B which correspond to the surface protrusions 32A, 32B, 34A, 34B disposed on the inside of the support post 30, as described herein. In this manner, the surface protrusions 32A, 32B, 34A, 34B of the support post 30 will correspondingly mate with the surface indents 72A, 72B, 74A, 74B on the boot 70, proving a secure mating engagement there between. As before, the surface protrusions 32A, 32B, 34A, 34B and the surface indents 72A, 72B, 74A, 74B may be disposed on the corners of the corresponding element, as illustrated. While the surface protrusions 32A, 32B, 34A, 34B and the surface indents 72A, 72B, 74A, 74B are shown as comprising generally flat 90 degree surfaces, it is contemplated that any surface shapes may be implemented such that the surface protrusions 32A, 32B, 34A, 34B and the surface indents 72A, 72B, 74A, 74B correspondingly mate with one another and provide a secure interconnection.

Figure 7:
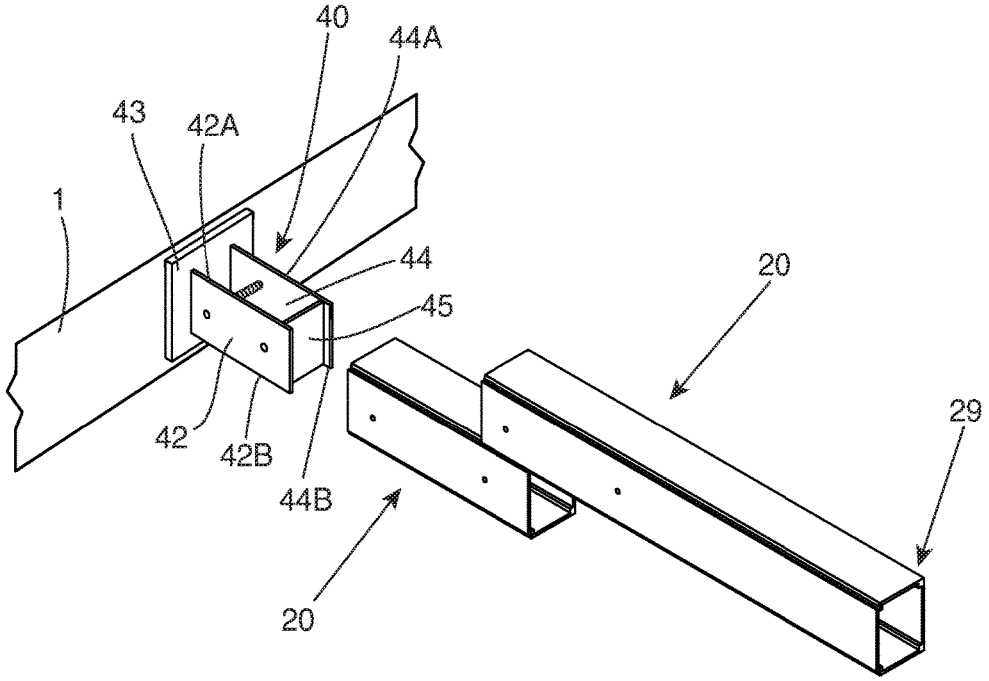
FIG. 7 is a perspective view of another beam support bracket and intermediate lateral beam as disclosed in accordance with at least one embodiment of the present invention.

Referring now to FIG. 7, yet another embodiment of the beam support bracket 40 is shown. Particularly, instead of being secured to a vertically oriented support post, the beam support bracket 40 may be secured to the structured 1, itself, such as a tie-beam, wall, post, pillar, etc. For instance, the beam support bracket 40 may include a base 43 secured to the structure 1, wherein the extension members 42, 44 extend outwardly there from. The lateral beam 20 may therefore slidingly engage with the beam support bracket 40 or extension members 42, 44, in the manner described herein. Other embodiments may include an intermediate beam 20' configured similarly to the lateral beam 20 in that the intermediate beam 20' can be slidingly engaged with the beam support bracket 40 in the same manner the lateral beam 20 can be secured, as described herein. As shown in FIG. 7, the lateral beam 20 may then be secured to the intermediate beam 20', for example, by providing bolts, screws, or other securing devices there between (not shown). The outer end 20 of the lateral beam 20 may then be slidingly engaged with another beam support bracket 40 to assemble the support assembly of the present invention.

Referring now to FIGS. 8A through 11, yet another embodiment of the support assembly 10 is illustrated. Specifically, in this embodiment, the support plates 42, 44 of the beam support bracket 40 may be disconnected, such that they are independent from one another. As described herein, the support plates 42, 44 are cooperatively configured with the internal portion 25 of the lateral beam(s) 20 such that the support plates 42, 44 slide within cooperatively structured channels so as to securely retain the beam(s) 20 onto the support plate(s) 42, 44.

Figure 9:
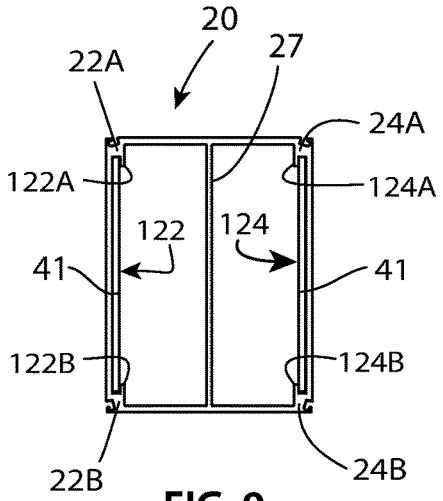
FIG. 9 is a cut-away view of the lateral beam along line 9-9 illustrated in FIG. 8C.

Particularly, with reference to the cut-away view of FIG. 9, the surface protrusions 22A, 22B are configured to define a first receiving channel 122 there between, and surface protrusions 24A, 24B are configured to define a second receiving channel 124. As provided above with regard to other embodiments, the elongated portion(s) 41 of the support plates 42, 44 are slidingly disposed within the receiving channels 122, 124. Still referring to FIG. 9, in at least one embodiment, the surface protrusions 22A, 22B include an extended lip 122A and 122B, respectively. Similarly, the surface protrusions 24A and 24B each include a corresponding extend lip 124A and 124B. These extended lips 122A, 122B, 124A, 124B are structured to further define the corresponding channels 122, 124, as well as facilitate in the retention of the support plate(s) 42, 44 and in particular the extended or elongated portions 41 thereof within the channels 122, 124. Specifically, the extended lips 122A, 122B, 124A and 124B extend from the corresponding surface protrusion and at least partially define the channel within which the support plate is disposed.

Still referring to FIG. 9, at least one embodiment of the present invention may further include a reinforcement wall or panel 27 disposed within the internal receiving portion of the lateral beam(s) 20. Particularly, the reinforcement wall or panel 27 may span across or between oppositely disposed surfaces or wall of the lateral beam 20 separating the internal receiving portion into at least two portions, such that the first receiving channel 122 and the second receiving channel 124 are disposed within different portions, as illustrated in FIG. 9. The reinforcement wall or panel 27 may extend longitudinally along the entire or a substantial portion of the lateral beam 20. This provides additional rigidity and strength to the lateral beam 20.

Figure 10:
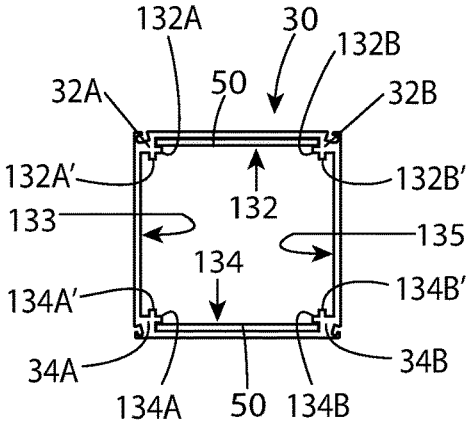
FIG. 10 is a cut-away view of the support post along line 10-10 illustrated in FIG. 8C.

FIG. 10 illustrates a cut-away view of the support post 30 showing the downward portions 50 of the support plates 42, 44 inserted therein. Particularly, as described herein, the support post 30 of at least one embodiment includes at least two elongated peripheral channels 132, 133, 134, 135 defined by a plurality of surface protrusions 32A, 32B, 34A, 34B. As shown in FIG. 10, the downward portions 50 of the support plates 42, 44 are inserted or slidingly engaged within two of the channels 132 and 134. However, it should be noted that, in at least one embodiment, the support bracket 40 may include more than two downward portions 50, such as in the corner embodiment illustrated in FIG. 12A. In that embodiment, the downward portions of the support plates may fit within three or all four of the channels 132, 133, 134, 135.

In any event, referring back to FIG. 10, in at least one embodiment, the plurality of surface protrusions 32A, 32B, 34A, 34B of the support post 30 may include extended lips or extenisions generally referenced as 132A, 132A', 132B, 132B', 134A, 134A', 134B, 134B'. These extended lips or extensions further define the elongated peripheral channels within which the downward portion 50 of the support plate(s) 42, 44 may be disposed.

Figure 11:
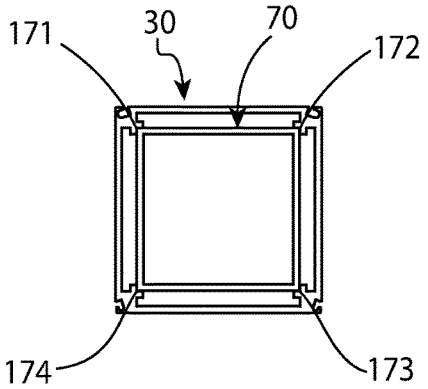
FIG. 11 is a cut-away view of the support post along line 11-11 illustrated in FIG. 8C.

Furthermore, the extended lips of the support post 30 may also define a center channel through which the support boot 70 may be disposed. For instance, the support boot 70 may include external corner surfaces or portions 171, 172, 173, 174 that engage or mate with the surface protrusions on the interior of the support post 30. Particularly, in the embodiments shown, the extended lips or extensions of the surface protrusions may define L-shaped corner receiving portions that will mate with the corners of the support boot 70, as shown in FIG. 11, for example.

Referring back to FIG. 8A, the support plates 42, 44 of at least one embodiment further include a plurality of notches 145, for example, where the lateral elongated portion 41 and the downwardly extended portion 50 meet. It should be noted that both of the support plates 42, 44 are identical in construction such that the they both include notches 145, even though the notches in the support plate 44 are not visible in FIG. 8A.

Specifically, the notches 145 are structured to receive a corresponding upper edge 135 of the support post 30 therein when the downward portion 50 of the support plate is slidingly disposed within the support post 30, as described herein. For example, FIG. 8B illustrates a front plan view wherein the support plate 42 is disposed within the support post 30 and the notches 145 have received the upper edge 135 of the support post 30 therein. In this manner, the lower edge 42B of the elongated portion 41 of the support plate 42 may extend or be disposed slightly below the upper edge 135 of the support post 30.

Figure 8A:
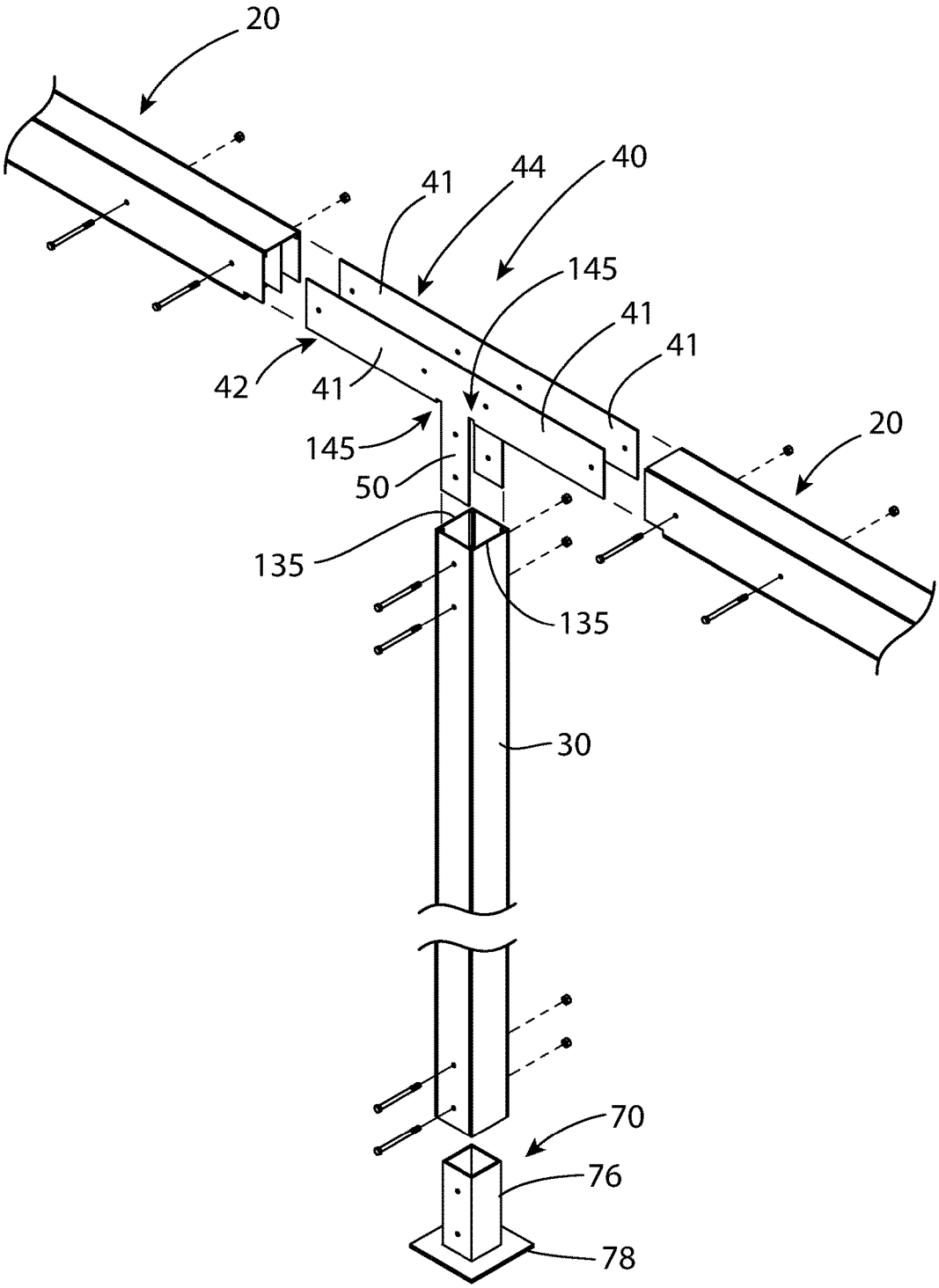
FIG. 8A is a perspective and partially exploded view of yet another embodiment of the present invention.
Figure 8B:
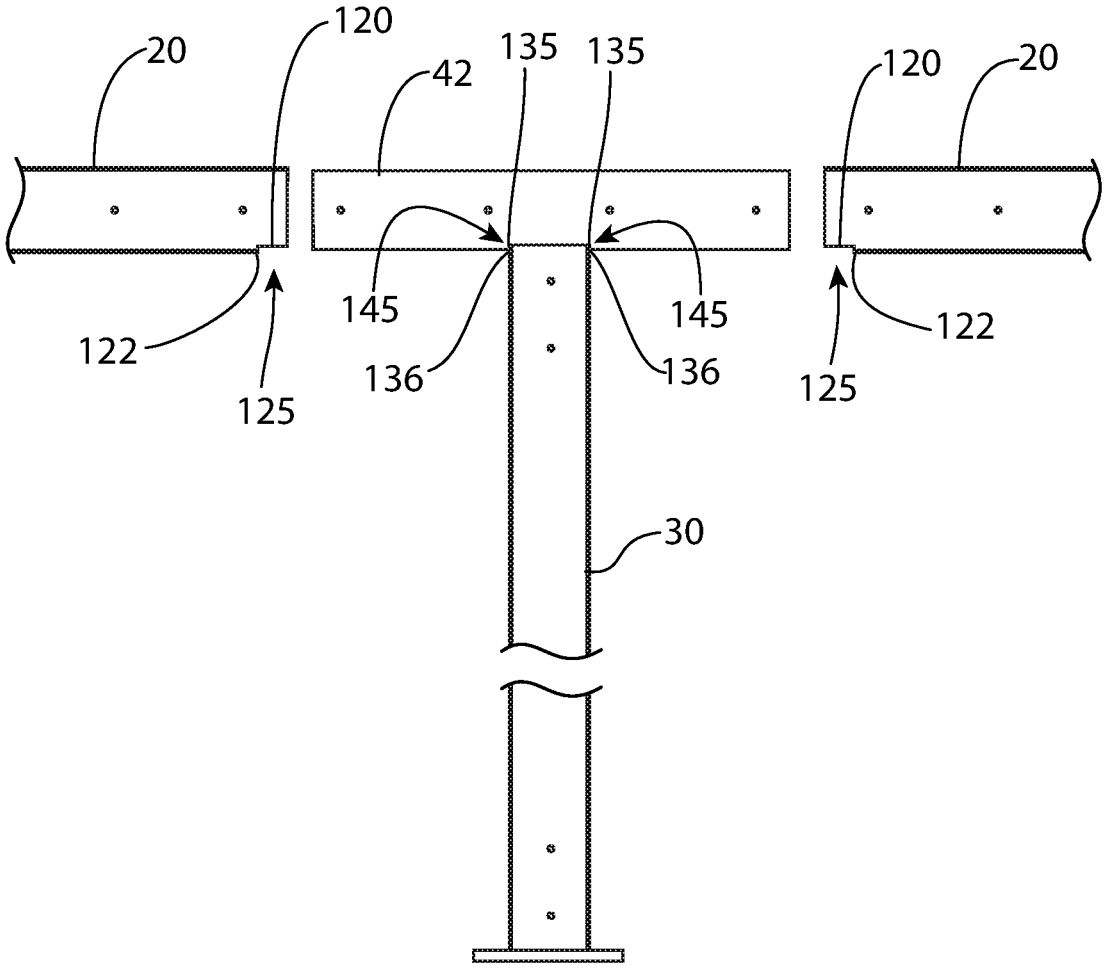
FIG. 8B is an elevation and partially exploded view of the embodiment illustrated in FIG. 8A.
Figure 8C:
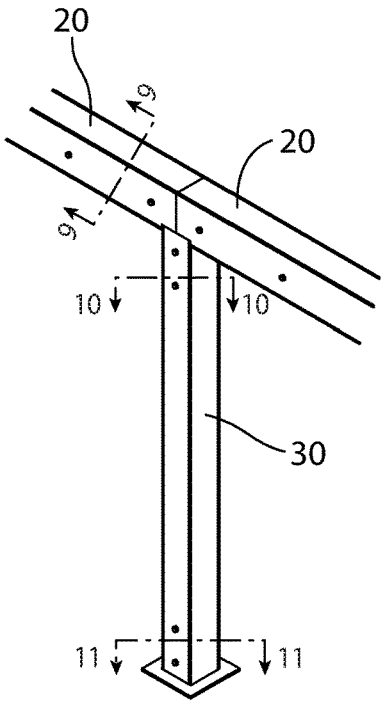
FIG. 8C is a perspective, assembled view of the embodiment illustrated in FIGS. 8A and 8B.

Furthermore, still referring to FIGS. 8A and 8B, the lateral beam(s) 20 of at least one embodiment may include a notch 125 disposed on at least one end 21, 29 of the beam 20. The notch 125 may be defined by a recessed lower edge 120 and a recessed lip 122, as shown in FIG. 8B. The recessed lower edge will be disposed at least partially over or on top of the upper edge 135 of the support post 30, and the recessed lip 122 will mate with an upper portion or surface 136 of the support post 130. The connected assembly is illustrated in FIG. 8C.

Figure 12A:
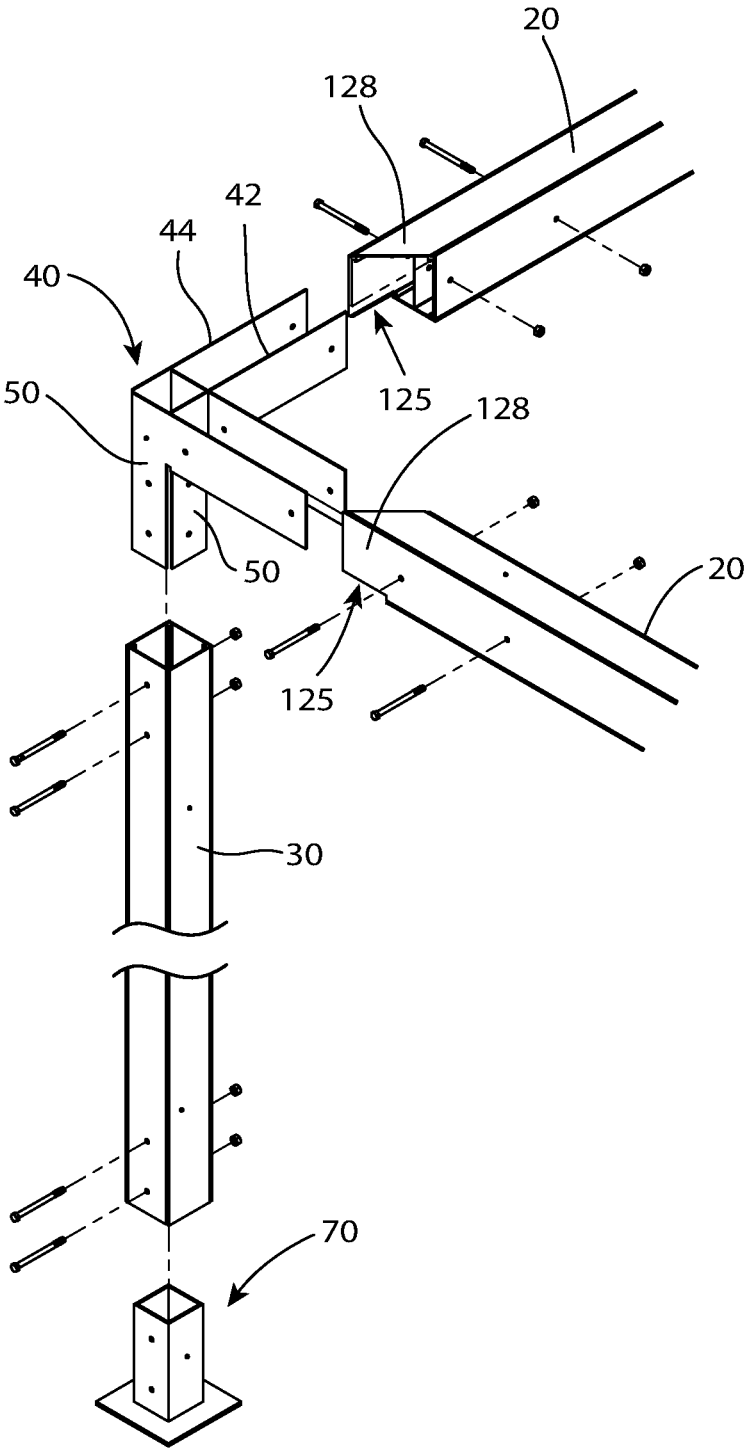
FIG. 12A is a perspective and exploded view of yet another embodiment of the present invention.
Figure 12B:
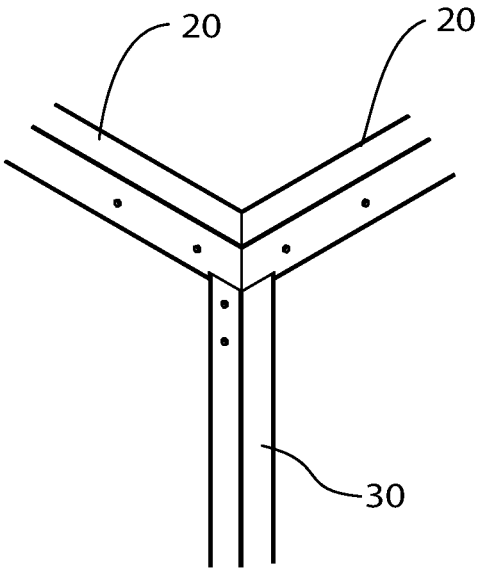
FIG. 12B is a perspective and assembled view of the embodiment illustrated in FIG. 12A.

Referring now to FIGS. 12A and 12B, yet another embodiment of the present invention is illustrated, and in particular, a corner embodiment is shown. Specifically, the bracket 40 may include one or more support plates 42, 44 with elongated portions 41 and one or more downward extended portions 50, as provided herein, although configured to be implemented or assembled on a corner. In the illustrated embodiment, the bracket 40 includes four downward portions 50, which correspondingly fit within the four elongated peripheral channels on the interior of the support post 30.

Furthermore, the lateral beams 20 may include corner extensions 128 on at least one end so as to extend all the way to the corner and meet with one another, as shown in FIG. 12B.

Figure 13B:
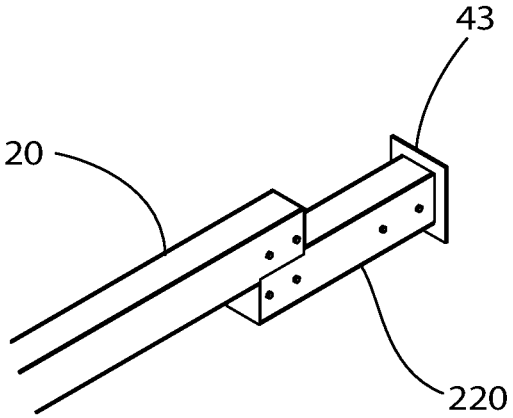
FIG. 13B is a perspective and assembled view of the embodiment illustrated in FIG. 13A.
Figure 13A:
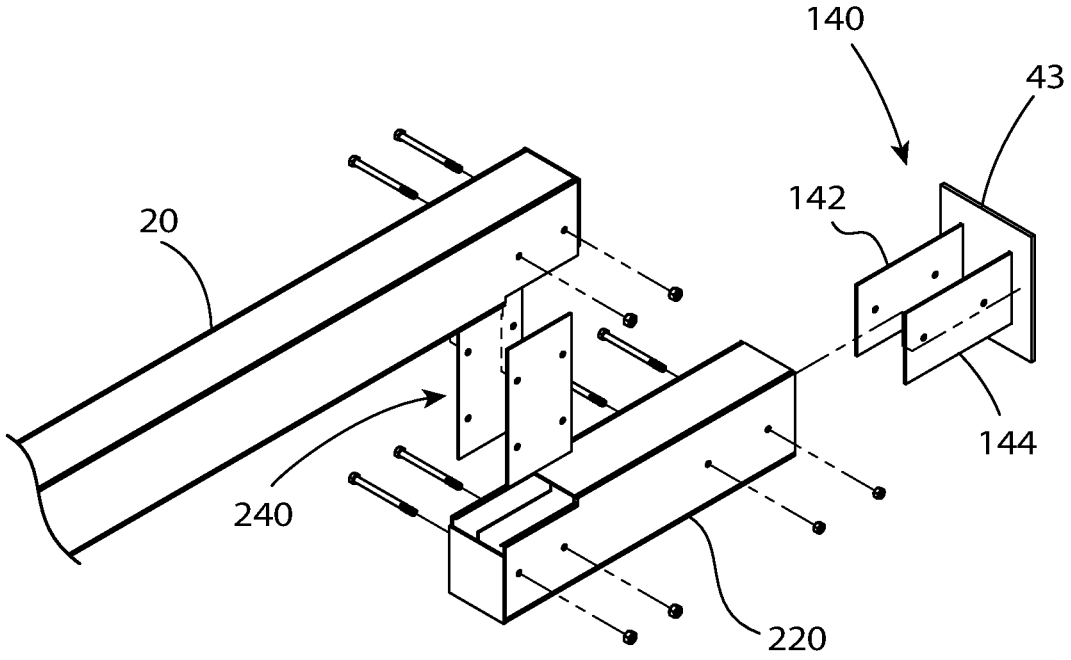
FIG. 13A is a perspective and exploded view of yet another embodiment of the present invention.

FIGS. 13A and 13B illustrate another embodiment of the support assembly 10. Particularly, instead of being secured to a vertically oriented support post, at least one beam support bracket 140 may be secured to the structure, itself, such as a tie-beam, wall, post, pillar, etc., or to an existing post. For instance, the beam support bracket 140 of this embodiment may include a base 43 secured to the structure, wherein the extension members 142, 144 extend outwardly there from. Although not shown, the lateral beam 20 may therefore slidingly engage with the beam support bracket 140 or extension members 142, 144, in the manner described herein. Other embodiments, as illustrated in FIGS. 13A and 13B, may include an intermediate beam 220 configured to slidingly engage with the beam support bracket 140 in the same manner as the lateral beam 20 can be secured, as described herein. As shown in FIG. 13A, the lateral beam 20 may then be secured to the intermediate beam 220, for example via an additional support bracket 240. In particular, the additional support bracket 240 may include two spaced apart support plates that slidingly engage between the lateral beam 20 and the intermediate beam 220 via receiving channels in a similar manner as described herein, for example, via surface protrusions disposed on the interior surfaces of the corresponding beams 20, 220 to define corresponding receiving channels.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A support assembly, comprising:

a beam support bracket comprising first and second support plates, wherein each of said first and second support plates comprise at least one lateral elongated portion and at least one downwardly extended portion, at least one lateral beam slidingly engaged with said at least one lateral elongated portion of each of said first and second support plates, said at least one lateral beam comprising an internal receiving portion comprising first and second receiving channels, wherein said at least one lateral elongated portion of said first support plate of said beam support bracket is disposed at least partially within said first receiving channel, and said at least one elongated portion of said second support plate is disposed at least partially within said second receiving channel, and a support post sliding engaged with said downwardly extended portion of each of said first and second support plates, wherein each of said first and second support plates comprise a notch structured to receive an upper edge of said support post therein.

2. The support assembly as recited in claim 1 wherein said first receiving channel is defined by a first surface protrusion pair within said internal receiving portion of said at least one lateral beam, and said second receiving channel is defined by a second surface protrusion pair within said internal receiving portion of said at least one lateral beam.

3. The support assembly as recited in claim 2 wherein said first surface protrusion pair is defined by two surface protrusions, wherein each of said two surface protrusions of said first surface protrusion pair comprise an extended lip further defining said first receiving channel.

4. The support assembly as recited in claim 3 wherein said second surface protrusion pair is defined by two surface protrusions, wherein each of said two surface protrusions of said second surface protrusion pair comprise an extended lip further defining said second receiving channel.

5. The support assembly as recited in claim 4 wherein said two surface protrusions of said first surface protrusion pair are disposed within two adjacent inner corners of said internal receiving portion of said at least one lateral beam.

6. The support assembly as recited in claim 5 wherein said two surface protrusions of said second surface protrusion pair are disposed within two other adjacent inner corners of said internal receiving portion of said at least one lateral beam.

7. The support assembly as recited in claim 4 wherein said at least one lateral beam further comprises at least one reinforcement wall disposed within said internal receiving portion.

8. The support assembly as recited in claim 7 wherein said reinforcement wall spans between oppositely disposed surfaces of said at least one lateral beam separating said internal receiving portion into at least two portions, said first receiving channel being disposed within one of said at least two portions and said second receiving channel being disposed within a different one of said at least two portions.

9. The support assembly as recited in claim 1 wherein said support post comprises an internal receiving portion comprising at least two elongated peripheral channels defined by a plurality of surface protrusions.

10. The support assembly as recited in claim 9 wherein said downward portion of said first support plate is disposed within one of said at least two elongated peripheral channels and said downward portion of said second support plate is disposed within a different one of said at least two elongated peripheral channels.

11. The support assembly as recited in claim 10 wherein each of said plurality of surface protrusions of said support post comprise at least one extended lip further defining said at least two elongated peripheral channels.

12. The support assembly as recited in claim 11 further comprising a lower support boot sliding engaged within a lower end of said support post, wherein said lower support boot comprises external corner portions which correspondingly mate with said plurality of surface protrusions of said support post.

13. The support assembly as recited in claim 12 wherein each of said plurality of surface protrusions of support post comprise two extended lips defining L-shaped corner receiving portions, wherein said external corner portions of said lower support boot mate with said L-shaped corner receiving portions.

14. The support assembly as recited in claim 1 wherein said notch is structured to receive an upper edge of said support post therein.

15. The support assembly as recited in claim 14 wherein said at least one lateral beam comprises notch defined by a recessed lower edge and a recessed lip, said recessed lower edge being disposed in an overlying relation to said upper edge of said support post.

* * * * *